United States Patent [19]

Zancaner

[11] Patent Number: 4,944,582

[45] Date of Patent: Jul. 31, 1990

[54] DEVICE FOR SUPPORTING SPECTACLES FRAMES

[76] Inventor: Alberto Zancaner, Piazza Roma, 8, 31040 Segusino (Treviso), Italy

[21] Appl. No.: 160,598

[22] Filed: Feb. 26, 1988

[30] Foreign Application Priority Data

Mar. 11, 1987 [IT] Italy ..... 21087/87[U]

[51] Int. Cl.[5] ..... G02C 1/00; A45C 11/04

[52] U.S. Cl. ..... 351/41; 351/158; 248/902; 206/5

[58] Field of Search ..... 351/41, 158; 248/DIG. 2; 211/13; 206/5

[56] References Cited

U.S. PATENT DOCUMENTS 3,040,881 6/1962 McNeill ..... 248/DIG. 2

*Primary Examiner*—Rodney B. Bovernick

*Attorney, Agent, or Firm*—Michael J. Striker

[57] ABSTRACT

The device comprises a base element, made of cardboard or the like material, and a spacer element adapted for quick application to the base element and for supporting the spectacles frame bridge portion.

1 Claim, 2 Drawing Sheets

DEVICE FOR SUPPORTING SPECTACLES FRAMES

BACKGROUND OF THE INVENTION

The present invention relates to an improved device for supporting spectacles, adapted for preventing the spectacles frames from being deformed.

As known, for storing and selling purposes, spectacles are frequently roughly handled, for example for introducing them into boxes, in which they are frequently arranged in a superimposed relationship.

In order to prevent spectacles from being damaged, for example by powder or mechanical surface stresses, said spectacles are usually enclosed in clear envelopes, possibly by using a rigid supporting member made, for example, of cardboard material.

Such a protection, on the other hand, is a scarcely valid one, since it is not able of properly holding the spectacles frame bridge, both because of possible pressures thereon and because of stresses due to the curved shape of the spectacles lenses.

Accordingly, the main object of the present invention is to provide a spectacles frame supporting device which is able of preserving the spectacles from possible contaminations by powder and the like, while preventing the spectacles frame bridge from being deformed.

SUMMARY OF THE INVENTION

The above mentioned object, as well as yet other objects, which will become more apparent hereinafter; are achieved by an improved device for supporting spectacles characterized in that it essentially comprises two elements, that is a sufficiently rigid element, made of cardboard or the like, adapted for supporting the spectacles frame and bent arms and a rigid element adapted to be easily applied to the supporting element for holding the frame bridge so as to operate as a spacer element between said frame bridge and said supporting element.

More specifically, according to one aspect of the present invention, the carboard supporting element, of rectangular contour, is provided, at the center of its top edge, with a recessed region adapted for receiving the spacer element and, at the top of each side edge, it is provided with a notch adapted for receiving a respective bent arm of the spectacles frame.

The spacer element, which is made of a plastics material, or any other suitable materials, has a dihedral shape and is provided, at its side edges, with elongated cuts, starting from the bottom, and adapted to provide, along each said edge, a thin and flexible strip which may slide on the rear face of the cardboard supporting element so as to allow for the spacer element to be easily and quickly applied thereon.

It should be pointed out that both the base supporting element and the spacer element can be made from any suitable materials.

Moreover, the spectacles-supporting device assembly may be preferably enclosed in a clear protecting envelope.

From the above disclosure the practical and functional advantages provided by the device according to the present invention will be self evident.

BRIEF DESCRIPTION OF THE DRAWINGS

The mentioned and other features, of constructional and functional nature, of the spectacles supporting device according to the present invention, specifically designed for preventing the spectables frame from being undesirably deform, will become more apparent from the following detailed description of a preferred embodiment thereof, which is illustrated, by way of an indicative example, in the accompanying drawings, where.

DESCRIPTION OF THE PREFERRED EMBODIMENT

Figure 1:
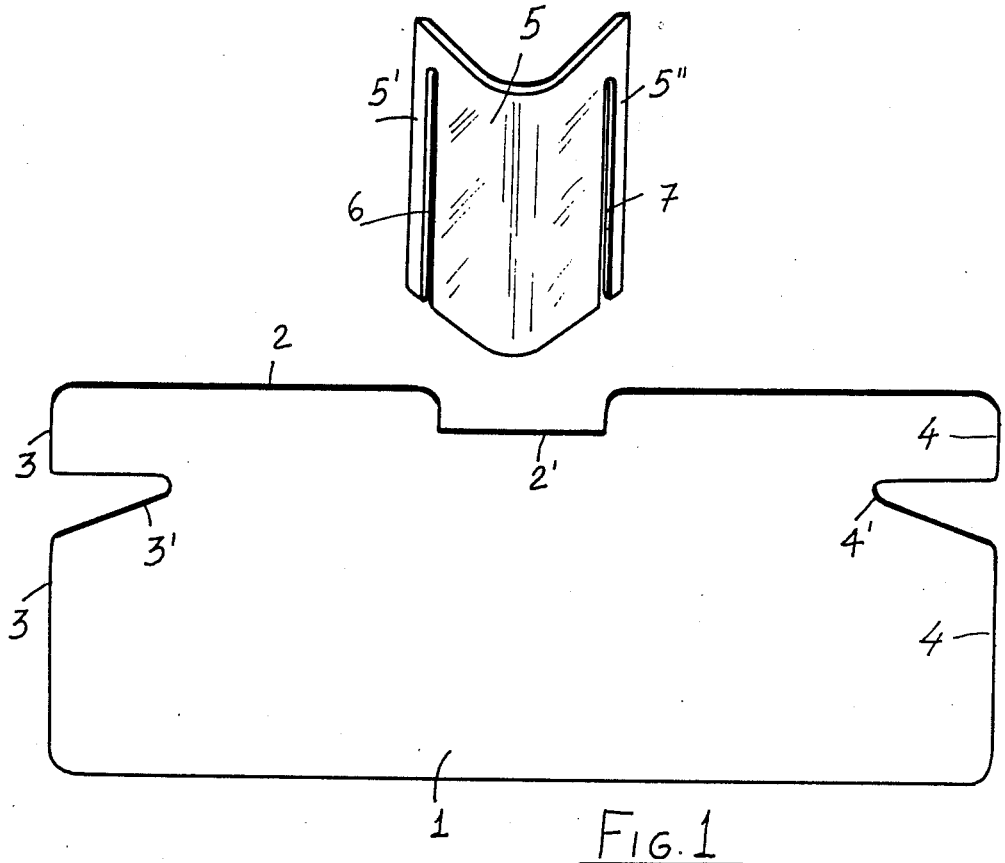
FIG. 1 is an exploded view illustrating the two elements forming the device according to the present invention, that is the supporting or base element and the spacer element.
Figure 2:
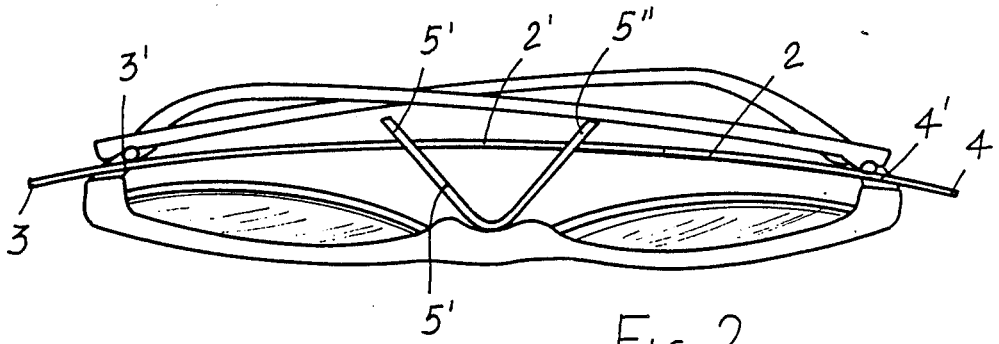
FIGS. 2 and 3 are a top and front view respectively illustrating the supporting device according to the present invention supporting a spectacles frame.
Figure 3:
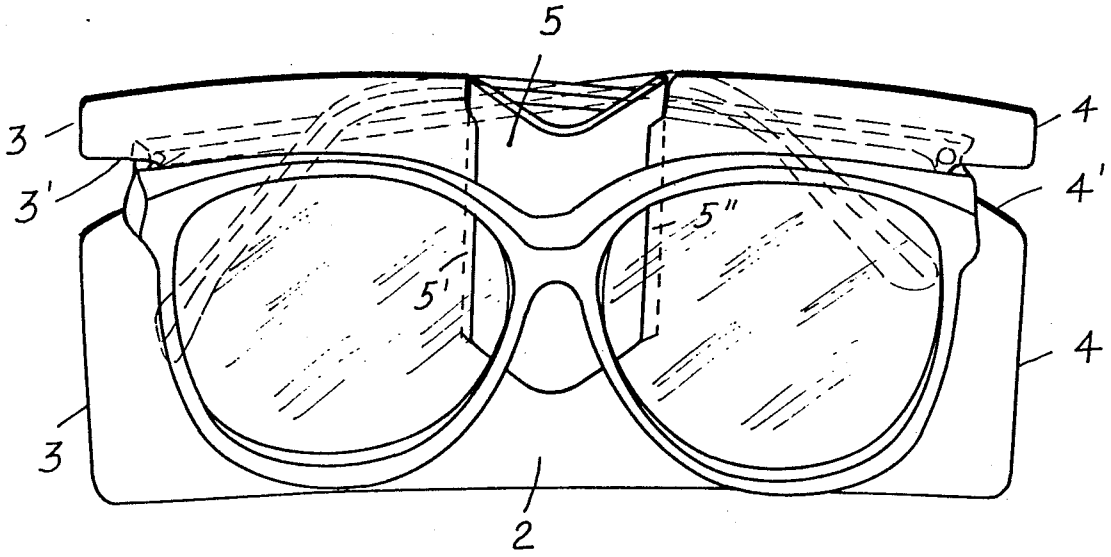

With reference to the above mentioned figures, the device for supporting spectacles according to the present invention comprises a base or supporting element 1, of rectangular contour and having preferably rounded corners, which supporting element is provided, at the central region of its top edge 2, with a recessed portion 2' and, at the top of the side edges 3 and 4, with notches 3' and 4'.

The device further comprises a spacer element 5, of dihedral shape, with a substantially rounded middle corner, which is provided at its side edges, with elongated cuts 6 and 7, starting from the bottom, which provide two thin and slightly flexible strips 5' and 5'' which are able of sliding along the rear face of the base or supporting element 1, in order to easily and quickly apply said spacer element 5 thereto.

In this connection it should be pointed out that the operation for coupling said spacer element to the base element and for removing it therefrom is very simple and quick which affords the possibility of storing in a separate conditions the two elements of the device according to the present invention, with a self evident space saving, since each element can be stacked on like elements.

While the invention has been disclosed and illustrated with reference to a preferred embodiment thereof, it should be apparent that it is susceptible to several modifications and variations all of which come within the spirit and scope of the invention as defined in the accompanying claims.

I claim:

1. A device for supporting a single spectacles frame having two glass loop portions, a bridge portion for joining the two loop portions, and two arms, said device comprising a substantially rectangular flat base element having rounded corners, a top portion, a central recess formed in said top portion, and opposite side notches for supporting the two arms in the bent condition of the arms; and a dihedral-shaped spacer element engageable in said central recess for supporting the bridge portion to prevent deformation of the bridge portion, and having a rounded corner portion for engaging the bridge portion, and spaced elongate cuts for removably engaging said flat base element.

* * * * *